United States Patent [19]

Stark et al.

[11] 4,067,630

[45] Jan. 10, 1978

[54] FILE DRAWER COMPRESSOR

[75] Inventors: Forest G. Stark, Jamestown; Dennis J. Signore, Ellicottville, both of N.Y.

[73] Assignee: AVM Corporation, Jamestown, N.Y.

[21] Appl. No.: 690,740

[22] Filed: May 27, 1976

[51] Int. Cl.[2] ..... A47B 88/00; A47B 95/02

[52] U.S. Cl. ..... 312/319; 220/22.3; 292/218

[58] Field of Search ..... 312/319; 292/218; 220/22.3, 22.4, 22.5

[56] References Cited

U.S. PATENT DOCUMENTS

| | | | |
|---|---|---|---|
| 1,265,081 | 5/1918 | Hatfield | 220/22.5 |
| 1,490,694 | 4/1924 | Brabson | 292/218 |
| 1,780,354 | 11/1930 | Larson et al. | 220/22.3 |
| 1,910,689 | 5/1933 | Gronberg et al. | 220/22.4 |
| 2,013,153 | 9/1935 | Hunter | 220/22.3 |
| 2,193,133 | 3/1940 | Hynes | 292/218 |
| 2,560,428 | 7/1951 | Fosberg | 220/22.4 |
| 2,585,612 | 2/1952 | Abrahamson | 220/22.3 |
| 2,631,590 | 3/1953 | Regenhardt | 220/22.5 |
| 2,689,573 | 9/1954 | Foehrenbach | 220/22.3 |

*Primary Examiner*—Paul R. Gilliam
*Assistant Examiner*—Victor N. Sakran
*Attorney, Agent, or Firm*—Bean, Kauffman & Bean

[57] ABSTRACT

A compressor for a file drawer is locked in position within a drawer by unitary spring rod, which serves to both define an operating handle and provide a bias for releasably retaining latch elements associated with opposite ends of the rod in latching engagement with the drawer. The spring rod is adapted for snap-fit attachment to the compressor.

13 Claims, 11 Drawing Figures

Fig. 5.
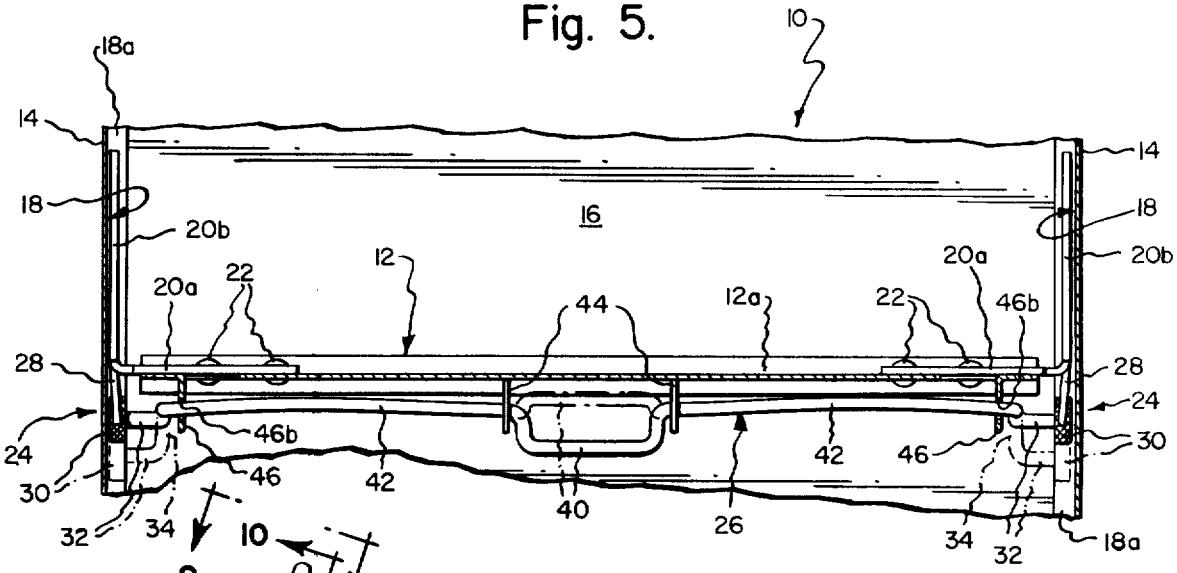
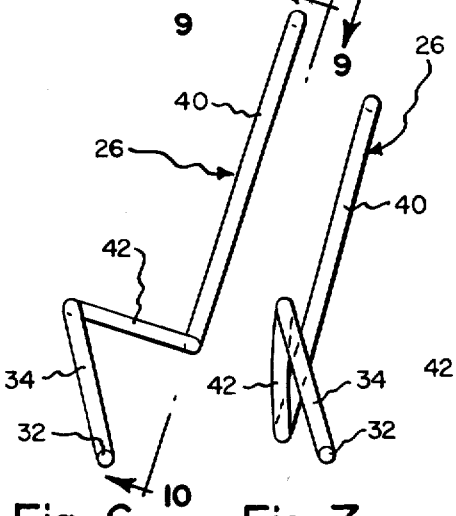
Fig. 6. Fig. 7.
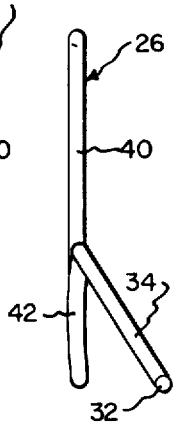
Fig. 8.
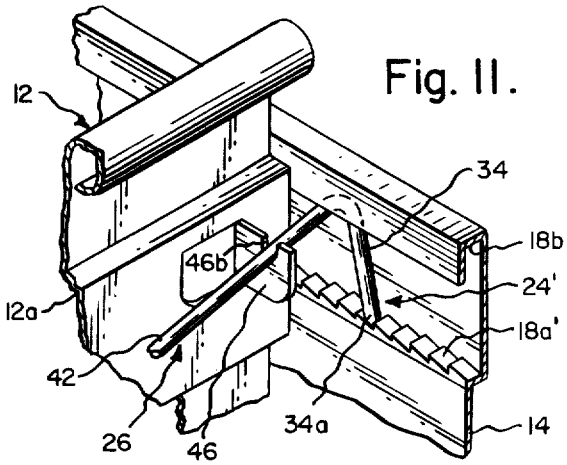
Fig. 11.
Fig. 9.
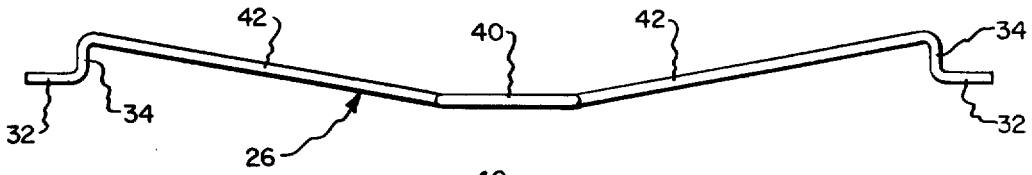
Fig. 10.
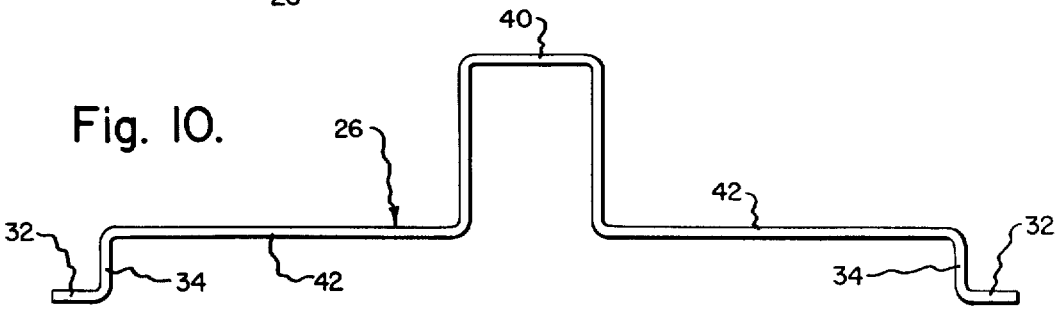

FILE DRAWER COMPRESSOR

BACKGROUND OF THE INVENTION

The present invention is directed towards an improved arrangement for releasably locking a compressor in a selected position within a file drawer.

The present construction is similar to the structures described in U.S. Pat. Nos. 1,910,689 and 2,689,573 in that it employs latching elements associated with opposite ends of a compressor mounted metal rod to releasably lock the compressor against movements relatively towards the rear of the drawer, while permitting free movement of the compressor towards the front of such drawer.

More specifically, in U.S. Pat. No. 1,910,689, the compressor is in the form of a plate, which is supported to upstand from within a drawer and extend transversely between the side walls of such drawer by means of a pair of compressor mounted guide shoes sized to be slidably fitted one within each of a pair of facing, longitudinally extending channels formed by the side walls. The compressor is releasably locked in position within the drawer by latching means including a pair of wedge or cam members, which are fixed one to each of the guide shoes to extend rearwardly of the compressor one within each of the side wall channels, and latching elements, which are in the form of a pair of rollers freely journaled on stub shaft extensions of crank arms formed integrally with opposite ends of a compressor mounted metal rod and arranged within the side wall channels for releasable camming engagement with facing surfaces of the wedge members and channels. The metal rod is arranged to extend horizontally across the rear surface of the compressor intermediate the crank arms and has a centrally disposed portion thereof non-rotatably fixed to an operating member or handle. The operating member is supported within a pair of upwardly opening bearing notches, which are defined by compressor mounted, centrally disposed support flanges, for pivotal movements about a horizontal axis disposed vertically above the rod, whereby to effect unlocking and locking movements of the rollers, as the operating member is pivoted towards and away from the compressor, respectively. Opposite ends of the rod disposed relatively inwardly of the crank arms, are constrained for rotary/vertical reciprocating movements within aligned slot openings defined by compressor mounted, end guide flanges, and the mid-portion of the rod is constrained by the operating member support flanges for arcuate movements and to prevent removal of the operating member from within the bearing notches when the compressor is in use.

As a result of the above described construction, pivotal movement of the operating member towards the compressor into its release position is disclosed as imparting movement to the rod in two directions, namely, the rod is first turned or rotated about its axis by an amount corresponding to the angular displacement of the operating member, and the mid-portion of the rod is moved rearwardly away from the compressor by an amount determined by the angular displacement of the operating member. It is asserted that the turning movement of the rod serves to turn the crank arms sufficiently to move the rollers to an unlocked position, whereas the arcuate movement of a mid-portion of the rod away from the compressor serves to spring the rod sufficiently so that its tendency to assume its original position serves to rotate the crank arms in order to return the rollers to their locking position, as well as to return the operating member to its initial or rest position, when the operating member is released.

Upon study of the operational characteristics of the compressor latching arrangement disclosed in U.S. Pat. No. 1,910,689, it would appear that a drawback of such arrangement is the difficulty with which it can be assembled/disassembled relative to the compressor and/or the drawer, and the additional fabricating steps required by making the metal rod/operator member of multiple piece construction.

U.S. Pat. No. 2,689,573 discloses a compressor locking arrangement, which is comparable in construction and mode of operation to that described in U.S. Pat. No. 1,910,689, except that the latching elements are defined by the free ends of crank arm like members carried adjacent the ends of an operating rod and that such latching elements are arranged for engagement with serrations of locking slots defined by the side wall channels. As in an alternative construction described in U.S. Pat. No. 1,910,689, a separate spring device is employed to bias the rod for rotation in order to normally retain the locking elements in their locking position.

SUMMARY OF THE INVENTION

The present invention is directed towards ans improved arrangement for releasably locking a compressor in position within a file drawer and more particularly towards a locking arrangement featuring a unique spring rod and mode of attaching same to the compressor.

A spring rod/spring rod mounting arrangement formed in accordance with a preferred form of the present invention is characterized in that an operating member is formed as an integral part of the spring rod; the spring rod is inherently operable to support diverse types of conventional latching elements for movement between compressor locking and unlocking positions; the spring rod is operable to provide a bias for positively maintaining the latching elements in their drawer locking positions, when the operator member is in its operative or rest position; and the spring rod is adapted for removable snap fit association with the compressor, while the latter is installed in the drawer.

In a presently proposed commercial form of the present invention, the latching elements carried by the crank arms of the spring rod would be in the form of stub shaft mounted roller devices intended to cooperate with compressor carried wedge members in essentially the same manner as that disclosed in U.S. Pat. No. 1,910,689.

Alternatively, the latching elements may be defined by free ends of the crank arms and would be adapted to cooperate with guide channel defined recesses or serrations or otherwise defined friction surfaces in a manner to that described in U.S. Pat. No. 3,689,573.

DRAWINGS

The nature and mode of operation of the present invention will now be more clearly described in the following detailed description taken with the accompanying drawings wherein:

FIG. 5 is a sectional view taken generally along the line 5—5 in FIG. 2;

FIG. 6 is an end elevational view of the spring rod employed in the present invention in its as-fabricated configuration;

FIG. 7 is a view similar to FIG. 6, but showing the spring rod in its installed-compressor locking configuration;

FIG. 8 is a view similar to FIG. 7, but showing the spring rod in its installed-compressor unlocking configuration;

FIG. 9 is a top plan view of the spring rod shown in FIG. 6;

FIG. 10 is a side elevational view of the spring rod shown in FIG. 6; and

FIG. 11 is a fragmentary perspective view illustrating an alternative locking arrangement.

DETAILED DESCRIPTION

Figure 1:
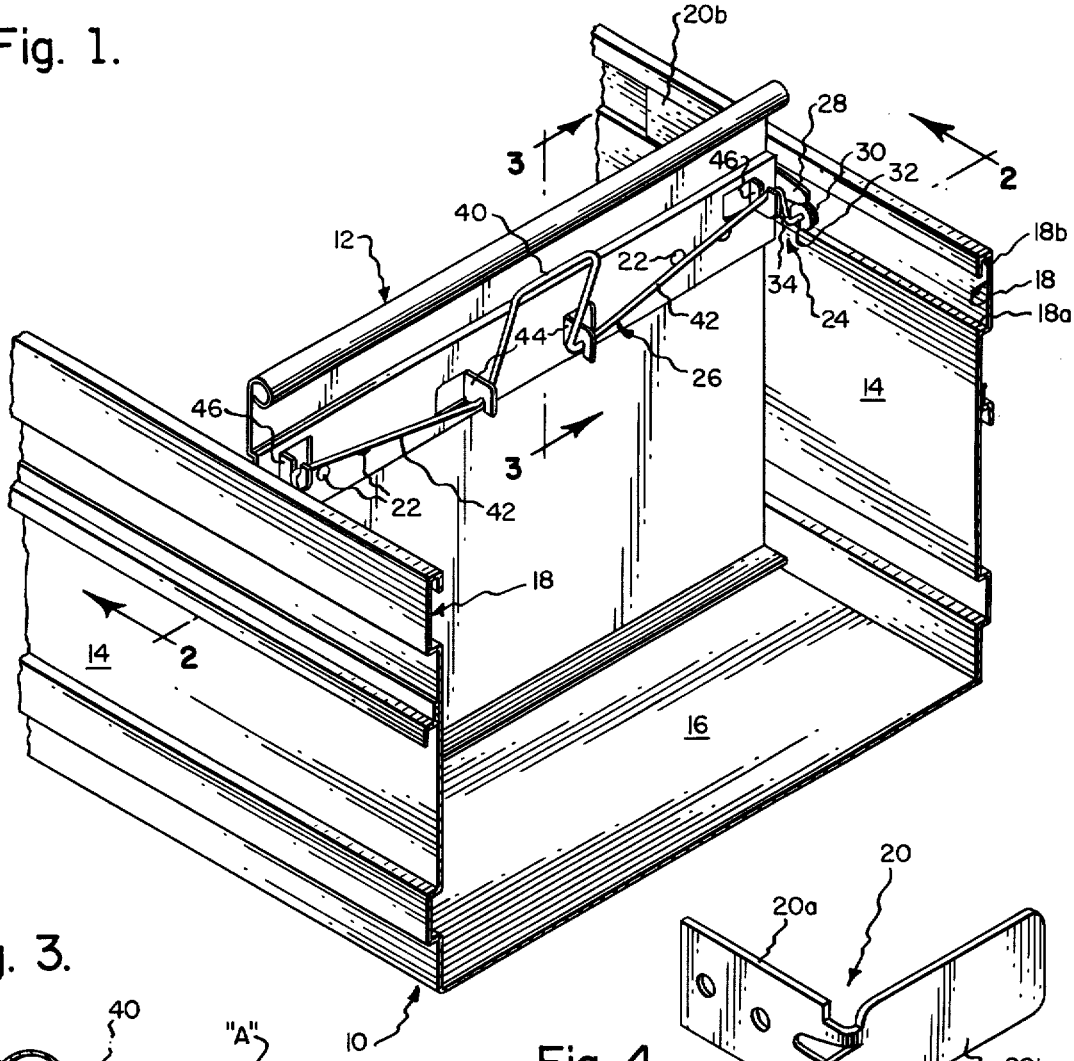
FIG. 1 is a perspective view of a file drawer incorporating a compressor locking arrangement formed in accordance with a preferred form of the present invention.
Figure 3:
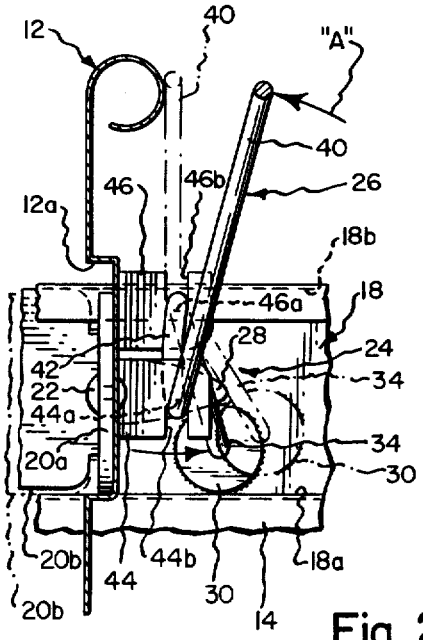
FIG. 3 is a sectional view taken generally along the line 3—3 in FIG. 1.
Figure 4:
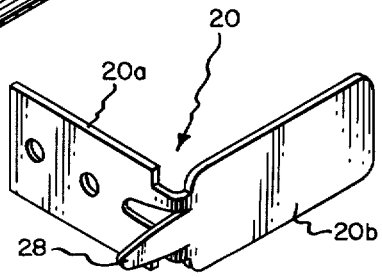
FIG. 4 is a perspective view of a guide-cam shoe employed in the embodiment of the invention illustrated in FIG. 1.
Figure 2:
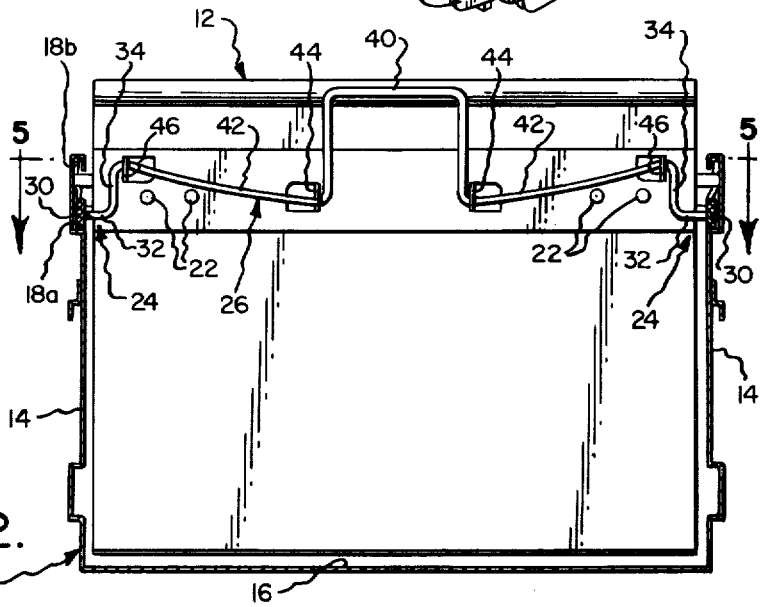
FIG. 2 is a sectional view taken generally along the line 2—2 in FIG. 1.

Reference is now made particularly to FIGS. 1, 2 and 5, wherein a file drawer 10 is shown in combination with a compressor 12 of a type commonly employed to maintain contents of the drawer in upright and compact condition.

Drawer 10 may be of conventional construction and fabricated from sheet metal or other suitable material, such as to define a pair of side walls 14, which are connected by a bottom wall 16, and front and rear walls, not shown. For purposes of the present description, drawer 10 may be characterized as having a pair of facing and longitudinally extending guide/locking channels 18, which are formed integrally with side walls 14, but may of course be separately formed and suitably secured to facing surfaces thereof, as by a welding operation.

Compressor 12 may also be of a conventional construction from the standpoint that it is in the form of a sheet metal or like plate, which is formed with a transversely extending rigidifying channel 12*a* and sized to extend transversely of drawer 10 essentially between side walls 14. Compressor 12 may be suitably supported to vertically upstand within drawer 10 and for sliding movements longitudinally thereof, as by a pair of shoes 20 having a pair of mounting portions 20*a*, which are suitably fixed within opposite ends of compressor channel 12*a*, as by rivet or bolt devices 22; and guide portions 20*b*, which are sized to be slidably received one within each of channels 18 intermediate channel bottom and top wall surfaces 18*a* and 18*b*, respectively. Compressor 12 may be releasably locked against rearwardly directed sliding movements within drawer 10, e.g., to the right, as viewed in FIG. 3, by means of a pair of standard latch or locking devices 24, whose operation is controlled by a compressor mounted spring rod 26 fabricated and mounted in accordance with the present invention. The form of latch devices 24 illustrated in FIGS. 1-5 is similar to that described in U.S. Pat. No. 1,910,689 from the standpoint that they include a pair of wedge or cam members 28, which are formed integrally one with each of shoes 20 and arranged to extend rearwardly of compressor 12 one within each of channels 18 and a pair of latch elements in the form of serrated rollers 30, which are arranged one within each of channels 18 and journaled on stub shaft extensions 32 of crank arms 34 formed as an integral part of spring rod 26. As in this prior construction, spring rod 26 additionally includes a centrally disposed operating portion 40 and a pair of mounting portions 42, which have their inner ends connected to operating portion 40 and their outer ends connected to crank arms 34; and the spring rod is mounted on compressor 12 by a pair of centrally disposed flanges 44 and a pair of opposite end flanges 46, which extend rearwardly of the compressor for supporting the inner and outer ends, respectively, of mounting portions 42. Also, as in this prior construction, the present spring rod construction has an operative position shown in full line in FIGS. 1-3 and 5, wherein rollers 30 are disposed in locking positions in which they are arranged vertically intermediate and for frictional engagement with wedge members 28 and channel bottom surfaces 18*a*. Accordingly, rollers 30 are operative to cam or tilt shoe guide portion 20*b* upwardly into frictional locking engagement with channel top surfaces 18*b*. As will be apparent, this construction serves to normally lock or constrain compressor 12 from rearwardly directed movement within drawer 10, while permitting free movement of the compressor towards the front of the drawer for the purpose of maintaining drawer contents in an upright and compact condition. On the other hand, compressor 12 may be released for rearwardly directed movements within drawer 10 whenever an operator manually moves spring rod 26 into its released position in the direction indicated by arrow A in FIG. 3, which results in movement of rollers 30 into their unlocking positions, wherein they are withdrawn from frictional/camming engagement with members 28 and channel bottom walls 18*a*, as shown in broken line in FIGS. 3 and 5. Movement of rollers 30 into their unlocking position serves to free shoe guide portions 20*b* for movement under the influence of gravity downwardly into sliding association with channel bottom walls 18*a*, as is also indicated in broken line in FIG. 3.

The present construction differs from that disclosed in U.S. Pat. No. 1,910,689 with respect to the as-fabricated, pre-mounted configuration of spring rod 26 and the specific mode of attaching same to compressor 12. In this connection, it will be generally noted that the end bearing means defined by flanges 46 are disposed vertically above and in an essentially parallel relationship with the bearing means defined by centrally disposed flanges 44. More specifically, it will be noted by reference to FIG. 3 that the central bearing means defined by flanges 44 comprise bearing surfaces 44*a*, which are arranged adjacent the upper ends of downwardly opening mounting or bearing slots 44*b*, whereas the bearing means defined by flanges 46 are in the form of bearing surfaces 46*a* arranged adjacent the lower ends of upwardly opening mounting or bearing slots 46*b*. Preferably, bearing surfaces 44*a* and 46*a* are bisected by a common vertically disposed plane extending transversely of drawer 10.

Now referring to FIGS. 6, 9 and 10, it will be understood that in accordance with the preferred form of the present invention, spring rod 26 is characterized in that operating portion 40 is of an inverted, U-shaped configuration and defines an operating handle formed integrally with mounting portions 42. However, if desired, operating portion 40 may be formed in a manner similar to that described in U.S. Pat. No. 1,910,689 and have a separately formed operating handle fixed thereto. Further, spring rod 26 is characterized as having an as-fabricated configuration, wherein mounting portions 42 are arranged to extend in a diverging relationship from adjacent operating portion 40 in a direction forwardly thereof and relatively towards the rear of compressor 12, as mounted, and in that crank arm portions 34 are arranged in essentialy parallel relationship and to extend downwardly and rearwardly from adjacent the outer ends of mounting portions 42. Preferably, mounting portions 42 are arranged to lie in essentially a common plane, which is disposed essentially normal to a plane defined by inverted, U-shaped operating portion 40. Also, the distance between the inner and outer ends of mounting portions 42 in a direction extending normal to the plane in which the operating portion is disposed, will preferably approximate or be more or less equal to the vertical spacing between bearing surfaces 44*a* and 46*a*.

The above described arrangement is such that spring rod 26 may be removably snap fit inserted within mounting openings 44*b* and 46*b* for bearing engagement with surfaces 44*a* and 46*a*, respectively, while compressor 12 is supported within drawer 10. As an incident to mounting of spring rod 26 on the compressor, the outer ends of mounting portions 42 are caused to be bent both rearwardly and upwardly relative to their inner ends, as will be apparent by comparison of FIGS. 2 and 10, FIGS. 5 and 9, and FIGS. 3, or 7 and 6. Resilient deformation of the spring rod in this manner produces a torsional effect operative to normally maintain rollers 30 in their locked position shown in FIG. 3, wherein such rollers act as a stop serving to prevent clockwise stress relieving movement of operating portion 40 beyond its normal operative position shown in FIG. 3. Whenever an operator causes movement of operating portion 40 into its release position shown in broken line in FIG. 3 and full line in FIG. 8, rollers 30 cease to function as a stop and crank arms 34 are caused to rotate with the spring rod such that rollers 30 move upwardly and rearwardly along a generally arcuate path of travel into their unlocking positions, also shown in broken line in FIG. 3. Upon release of operating portion 40, the additional bias introduced into the spring rod, as a result of movements of the operating portion into its release position, is operative to return the spring rod to its initial or locking condition shown in full line in FIG. 3.

FIG. 11 illustrates the utilization of spring rod 26 with an alternative locking device 24' of the general type disclosed in U.S. Pat. No. 2,689,573. More specifically, with this type of locking arrangement, the locking elements are defined by the free ends 34*a* of crank arms 34 and the lower channel surfaces 18*a'* define serrations, apertures or friction surfaces with which crank arm ends 34*a* are normally adapted to engage in order to releasably lock compressor 12 against rearwardly directed movements within the file drawer. However, movement of spring rod 26 into its release position, serves to effect upwardly and rearwardly directed swinging movements of crank arms 34 in the manner described with reference to FIG. 3, such that their ends 34*a* are released from locking engagement with channel lock surfaces 18*a'*, whereby to free the compressor for rearwardly directed movements under the control of an operator.

We claim:

1. In the combination of a file drawer, a compressor mounted by side walls of said drawer for longitudinally directed movements and locking means for releasably locking said compressor against rearwardly directed movements within said drawer, said locking means including a manually manipulatable spring rod and a pair of latch devices, said spring rod having a centrally disposed operating portion, a pair of mounting portions having their relatively inner ends fixed to said operating portion and a pair of crank arms fixed to relatively outer ends of said mounting portions, said spring rod being mounted rearwardly of said compressor by a pair of end bearing means and a pair of central bearing means arranged in a relatively spaced relationship and horizontally intermediate said end bearing means, said mounting portions having said inner ends thereof supported one by each of said central bearing means and said outer ends thereof supported one by each of said end bearing means, and said latch devices including latching elements carried one by each of said crank arms for movement between compressor locked and unlocked positions incident to movement of said spring rod between operative and release positions, respectively, the improvement comprising:

said end bearing means being disposed to lie essentially parallel to and vertically above said central bearing means, and said spring rod is characterized as having said mounting portions subject to resilient deformation incident to mounting of said mounting portions on said central and end bearing means for normally maintaining said spring rod in said operative position.

2. An improvement according to claim 1, wherein said central bearing means include rod bearing surfaces arranged adjacent upper ends of downwardly opening rod mounting slots, and said end bearing means include rod bearing surfaces arranged adjacent lower ends of upwardly opening rod mounting slots, thereby to permit removable snap fit mounting of said spring rod on said compressor.

3. An improvement according to claim 2, wherein said operating portion is characterized as being of an inverted U-shaped configuration and defines a handle formed integrally with said mounting portions.

4. An improvement according to claim 1, wherein said spring rod has an as-fabricated pre-mounted configuration characterized in that said mounting portions extend in a diverging relationship from adjacent said operating portion in a direction forwardly thereof relatively towards said compressor and in that said crank arm portions are arranged in an essentially parallel relationship and extend downwardly and rearwardly from adjacent said outer ends of said mounting portions.

5. An improvement according to claim 4, wherein the distance between said inner and outer ends of said mounting portions as measured in said direction approximates the vertical distance between said central and end bearing means.

6. An improvement according to claim 4, wherein said mounting portions lie in essentially a common plane in said as-fabricated pre-mounted configuration of said spring rod.

7. An improvement according to claim 6, wherein said operating portion is formed integrally with said mounting portions and is characterized as being of an inverted U-shaped configuration and as residing in a plane arranged essentially normal to said common plane in said as-fabricated pre-mounted configuration of said spring rod.

8. An improvement according to claim 7, wherein said central bearing means include rod bearing surfaces arranged adjacent upper ends of downwardly opening rod mounting slots, and said end bearing means include rod bearing surfaces arranged adjacent lower ends of upwardly opening rod mounting slots, thereby to permit removable snap fit mounting of said spring rod on said compressor.

9. An improvement according to claim 8, wherein the distance between said inner and outer ends of said mounting portions as measured in said direction approximates the vertical distance between said central and end bearing means.

10. In the combination of a file drawer, a compressor mounted by side walls of said drawer for longitudinally directed movements and locking means for releasably locking said compressor against rearwardly directed movements within said drawer, said locking means including a manually manipulatable spring rod and a pair of latch devices, said spring rod having a centrally disposed operating portion, a pair of mounting portions having their relatively inner ends fixed to said operating portion and a pair of crank arms fixed to relatively outer ends of said mounting portions, said spring rod being mounted rearwardly of said compressor by a pair of end bearing means and a pair of central bearing means arranged in a relatively spaced relationship and horizontally intermediate said end bearing means, said mounting portions having said inner ends thereof supported one by each of said central bearing means and said outer ends thereof supported one by each of said end bearing means, and said latch devices including latching elements carried one by each of said crank arms for movement between compressor locked and unlocked positions incident to movement of said spring rod between operative and release positions, respectively, the improvement comprising:

said central and end bearing means each defining bearing surfaces and mounting slots communicating with said bearing surfaces, said bearing surfaces of said end bearing means being disposed to lie essentially parallel to and vertically above said bearing surfaces of said central bearing means, and said spring rod is characterized as being removably insertable through said mounting slots for mounting on said central and end bearing means in bearing association with said bearing surfaces thereof and as having said mounting portions subject to resilient deformation incident to mounting thereof on said central and end bearing means for resiliently retaining said spring rod in bearing association with said bearing surfaces and for normally maintaining said spring rod in said operative position.

11. The improvement according to claim 10, wherein said spring rod has an as-fabricated pre-mounted configuration characterized in that said mounting portions extend in a diverging relationship from adjacent said operating portion in a direction forwardly thereof relatively towards said compressor and in that said crank arm portions are arranged in an essentially parallel relationship and extend downwardly and rearwardly from adjacent said outer ends of said mounting portions.

12. The improvement according to claim 11, wherein the distance between said inner and outer ends of said mounting portions as measured in said direction approximates the vertical distance between said bearing surfaces of said central and end bearing means.

13. The improvement according to claim 12, wherein said mounting portions lie in essentially a common plane in said as-fabricated pre-mounted configuration of said spring rod and said operating portion is formed integrally with said mounting portions and is characterized as being of an inverted U-shaped configuration and as residing in a plane arranged essentially normal to said common plane in said as-fabricated pre-mounted configuration of said spring rod.

* * * * *